United States Patent [19]

Neidecker

[11] Patent Number: 4,750,897

[45] Date of Patent: Jun. 14, 1988

[54] ELECTRIC CONTACT APPARATUS

[75] Inventor: Rudolf Neidecker, Basel, Switzerland

[73] Assignee: Multi-Contact AG Basel, Switzerland

[21] Appl. No.: 863,444

[22] Filed: May 15, 1986

[30] Foreign Application Priority Data

May 20, 1985 [DE] Fed. Rep. of Germany ..... 3518030

[51] Int. Cl.[4] ..... H01R 4/48

[52] U.S. Cl. ..... 439/825; 439/851; 439/860

[58] Field of Search ..... 339/256 R, 256 RT, 256 C, 339/258 R, 258 A, 95 R; 439/816, 825–827, 851–854, 860

[56] References Cited

U.S. PATENT DOCUMENTS

| | | | |
|---|---|---|---|
| 3,314,044 | 4/1967 | Powell | 339/256 R |
| 3,861,776 | 1/1975 | Deal | 339/256 R X |
| 4,083,622 | 4/1978 | Neidecker | 339/256 R |
| 4,128,293 | 12/1978 | Paoli | 339/95 R X |
| 4,326,769 | 4/1982 | Dorsey et al. | 339/256 RT X |
| 4,447,108 | 5/1984 | Ghigliotti et al. | 339/258 R X |

FOREIGN PATENT DOCUMENTS

| | | |
|---|---|---|
| 1465090 | 7/1970 | Fed. Rep. of Germany . |
| 2527681 | 5/1978 | Fed. Rep. of Germany . |

*Primary Examiner*—John McQuade

*Attorney, Agent, or Firm*—Lalos & Keegan

[57] ABSTRACT

The contact apparatus has at least two contact bodies and at least one segmented body. The latter possesses bars separated from each other by slots and having a curved central area. Furthermore, the bars have the form of a three-dimensional curve. In their end areas, the bars possess in each case a section curved in the opposite sense to said curved central area. Besides, the bars are linked together at their ends by means of edge strips. Moreover, the slots extend up to the curved section. In this way, points of contact clearly defined as regards their position and values are assigned to the convexity as well as the end areas of each bar. These measures lead to an improvement of the mechanical and electrical characteristics of the contact apparatus.

10 Claims, 6 Drawing Sheets

FIG. 7
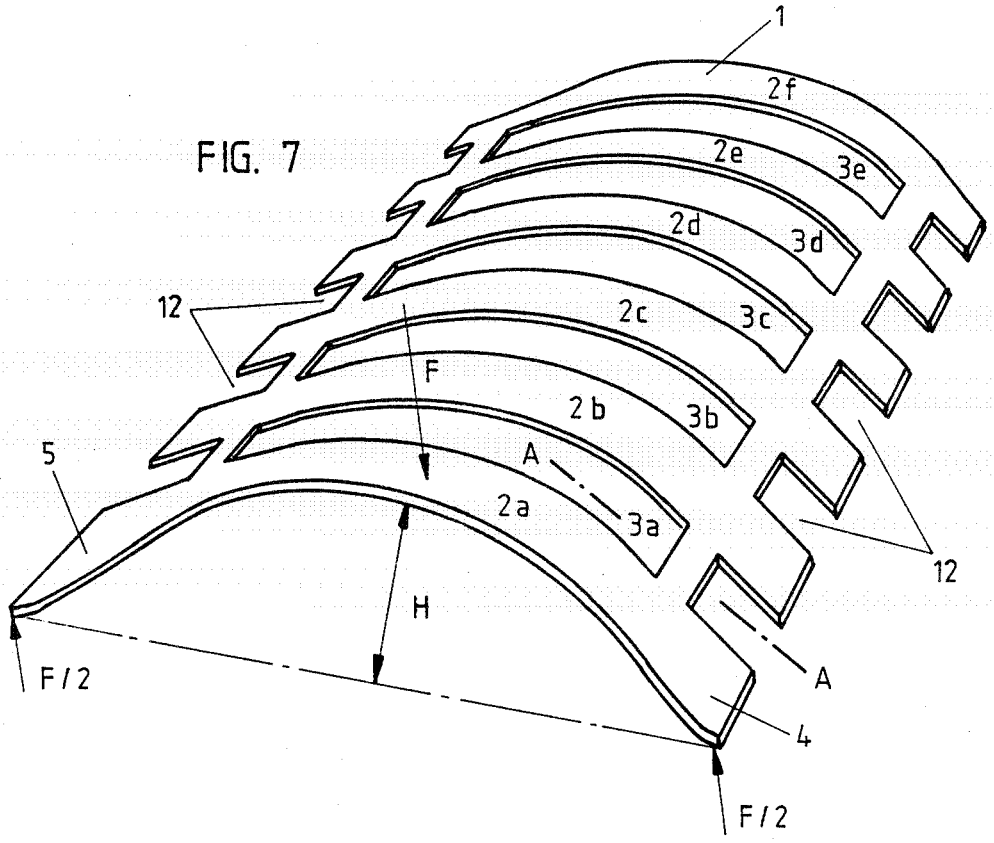
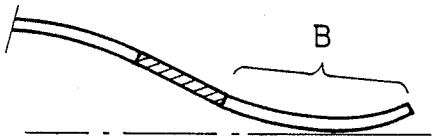
FIG. 8
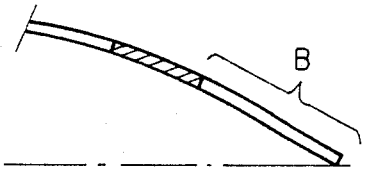
FIG. 9

ELECTRIC CONTACT APPARATUS

BACKGROUND OF THE INVENTION

Contact apparatuses of this kind are well-known from the DE-PS No. 25 27 681 and the DE-AS No. 14 65 090. There, the segmented body is formed by a—e.g. cylindrically curved or rolled—metal strip having the flexibility of a spring and being made of an electrically conductive material or having a sheath made of such a material. The bar-like strip sections remaining between the slots form the contact segments having a curved shape and protruding from the surface of the metal strip or the cylinder respectively. At their peak area, the contact segments enter into electrically conductive pressure contact with one of the contact bodies whilst the same kind of contact occurs between the other contact body and the end areas of the contact segments extending on both sides thereof or the edge zones in these end areas respectively, in order to guarantee a reliable contact making with small electrical transfer resistance. A contact force in the peak area causes the appearance of a couple of reaction contact forces of half the magnitude of said peak-located contact force at both corresponding points of contact in the edge zones.

In numerous applications, these well-known contact apparatuses function satisfactorily. However, in the case of a high contact current load and especially of frequent closing and opening operations, the use of such apparatuses causes the following problems:

Under the influence of the contact force F defined points of contact are in any case formed in the peak area of the segments whilst the points of contact in the edge zones on both sides are more or less undefined because of the contact with the corresponding contact body on a comparatively big surface. Thus, it may occur that, for several contact segments, only one single point of contact exists in each of said edge zones, having a comparatively small current-carrying contact surface and being therefore charged by an excessive current density and possibly an excessive transfer resistance as well.

In addition, the well-known apparatuses show an increased predisposition to mechanical abrasion if the plugging and separating process of contact bodies having the form of sockets and plugs takes place, especially in case of mechanical actuation of these contact bodies. It should be noted that the points of contact at the peak of the contact segments glide alongside the same line on the surface of the contact body if there is a relative motion of the contact bodies towards each other. The abrasion of the surface, often coated with a special contact material, concentrates therefore on these areas of the surface, what may lead to a premature destruction of the surface structure and, consequently, may create the conditions for the formations of oxide layers and the superheating of the contact apparatus as well.

SUMMARY OF THE INVENTION

The purpose of the present invention is to remedy the above-mentioned drawbacks and to improve an apparatus of this type in such a way that the mentioned disadvantages can be eliminated.

The purpose of the present invention consists therefore of the creation of a contact apparatus showing in the end areas at both sides of the contact segments distinctly defined points of contact for the reaction forces F/2. As an additional purpose, the present invention pursues the task to even the strain of the contact surfaces and, therewith, to diminish the surface abrasion if the plugging and separating process of the contact apparatus and of the sockets and plugs takes place respectively.

The essential advantages of the present invention are to be found in the fact that the electrical and mechanical characteristics of the contact apparatus will be improved.

Advantageous and useful improvements of the present invention result of a combination with features, well-known as such, which can be found in the dependent claims.

BRIEF DESCRIPTION OF THE DRAWINGS

The drawings depict schematically embodiments of the present invention which will be described more closely hereinafter. The figures in the drawings show.

DESCRIPTION OF PREFERRED EMBODIMENTS

All elements which are not absolutely necessary for the understanding of the apparatus according to the invention have been omitted. Similar elements in the various figures are bearing in each case identical reference symbols.

Figure 1:
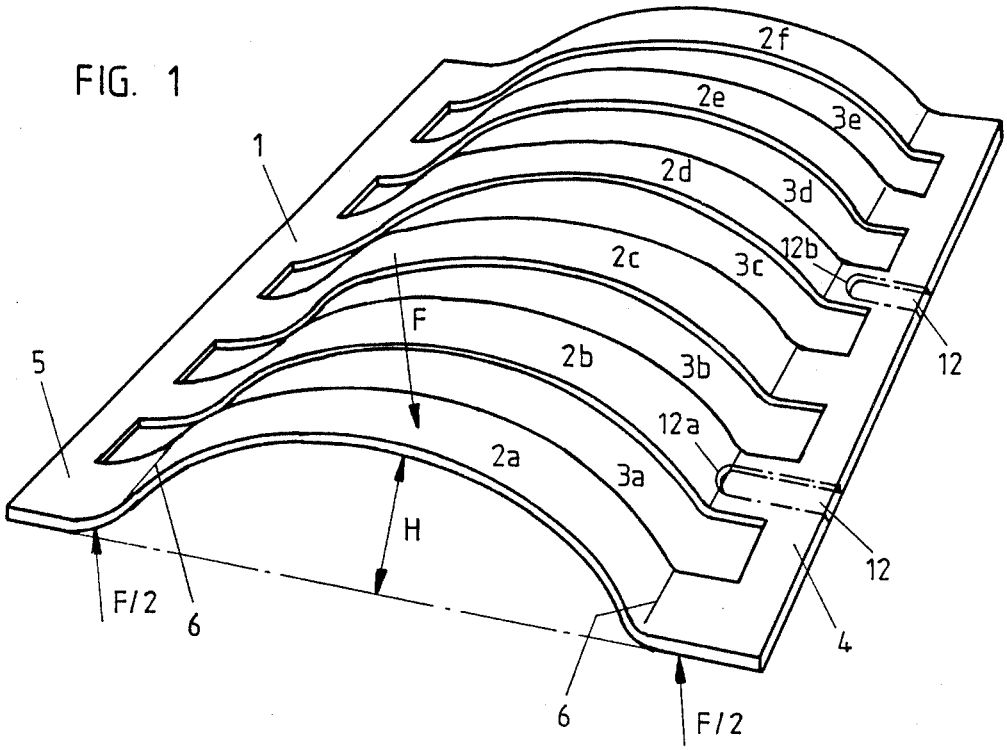
FIG. 1 a segmented body being especially suitable for the creation of an electrical connection between two flat contact bodies, FIG. 2 a segmented body having the form of a sleeve, FIG. 3 a segmented body in the form of a sleeve and having in its edge strip apertures in the form of slots, FIG. 4 a segmented body in the form of a sleeve and having in its edge strip apertures in the form of a gear cutting, FIG. 5 a segmented body similar to that depicted in FIG. 1 and having in its edge strip triangular apertures, FIG. 6 a segmented body similar to that depicted in FIG. 1, FIG. 7 a segmented body without a section curved in the opposite sense to the curved central area of the bars, FIG. 8 and FIG. 9 a sectional view along the line A—A in FIG. 7.

The segmented body depicted in FIG. 1 is manufactured of a material with good electrical conductivity and which, furthermore, ought to possess good spring qualities. As material, a Cu/Be-alloy could be chosen for example. However, it is also possible to use spring steel for the segmented body 1 and to plate it in the area of the contact surfaces with an electrical material of high conductivity. The segmented body has a plurality of bars 2*a*–2*f* which lie side by side and are separated from each other by slots 3*a*–3*e*. The width of the bars 2*a*–2*f* corresponds approximately to that of the slots 3*a*–3*e*. Basically, the metal strip material for the manufacture of the segmented body 1 can have any sizes, strengths and forms. These parameters will depend in a well-known manner on the predetermined dimension of the contact apparatus and the underlying electrical data.

The bars 2*a*–2*f* are of convex shaped and linked together mechanically at their ends by edge strips 4,5. The height H of the convexity of the bars 2*a*–2*f* formed according to the plate spring principle does not depend on the reciprocal distance of the bars 2*a*–2*f*, defined by the width of the slots 3*a*–3*e*, along said edge strips. From this it ensures that it is possible by an appropriate choice of the height H of the convexity to bridge also larger tolerances between two contact surfaces of contact bodies, which are to be electrically interconnected, without being obliged to decrease the number of the bars 2a–2f. This is in so far advantageous as the current load carrying capacity remains thereby fully intact.

The bars 2a–2f show at their end areas a section 6 curved in the opposite sense to the curved central area. In the embodiment according to FIG. 1 the edge strips 4,5 are then arranged in such an angle to the bars 2a–2f that they lie flatly upon the contact surface of the not represented lower contact body.

The points of contact between the likewise not represented upper contact body and the bars 2a–2f are to be found in the middle of the curved area of these bars. There, the contact force F presses whilst at the left and right edge strip 4,5 in each case the reaction forces F/2 are effective. The fact that the slots 3a–3e extend over the curved section 6 up to the edge strips 4,5 serves to overcome the naturally existing rigidity in this section so that the points of contact in the plane of the reaction forces F/2 have defined values, the repeatability of which on the occasion of each plug process is guaranteed. In this way points of contact clearly defined as far as their locations and value are concerned are assigned to each bar 2a–2f. This is true of the points of contact in the plane of the contact force F as well of those caused by the reaction forces F/2. In this manner it is possible to ensure that the making of electrical contacts between the several parts of the contact apparatus according to the invention occur in the best possible way. Each bar 2a–2f forms namely an autonomous bond with constant electrical characteristic data, whereby the transfer resistance of the contact apparatus can altogether be reduced substantially.

The edge strips 4,5 may be provided with apertures 12 which extend in each case from their outer edges up to the curved section 6 of a bar 2a–2f (compared with reference symbol 12a in FIG. 1). But is is also conceivable that these apertures 12 extend in each case merely towards the curved section 6 of bar 2a–2f, but not up to this section (compare with reference symbol 12b in FIG. 1). With these measures it is possible to achieve the goal according to which said points of contact may also lie in the area of the edge strips.

Figure 2:
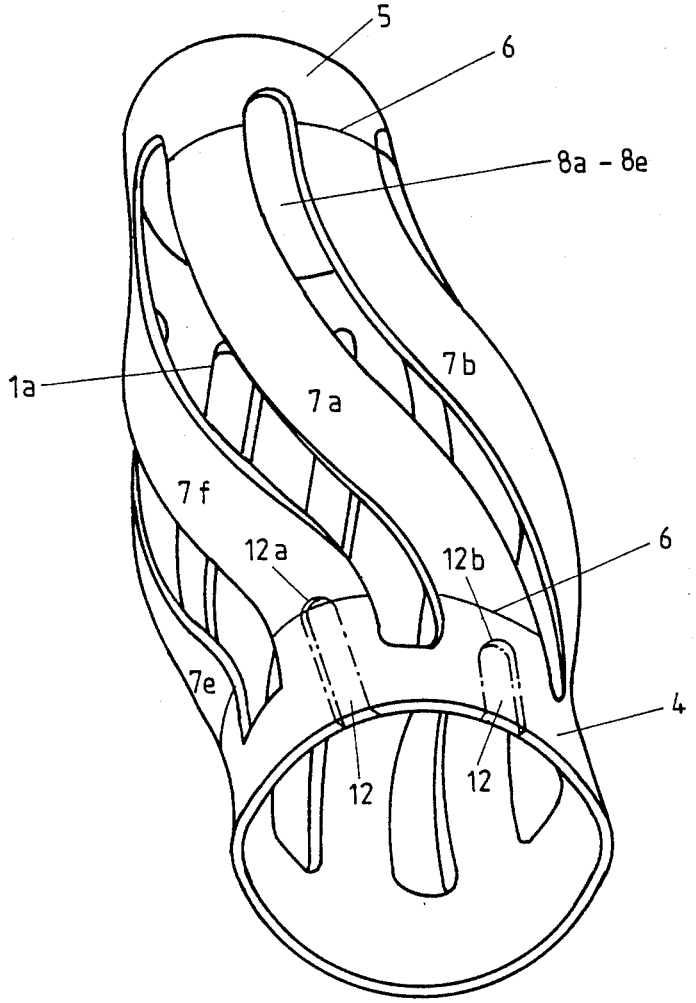

FIG. 2 shows a segmented body 1a in the form of a sleeve on which mechanical and electrical improvements are executed. As already mentioned in the context of the embodiment according to FIG. 1, the origin of the mechanical improvements likes in the fact that the slots 8a–8e extend over the curved section 6 up to the edge strips 4,5. The additional measure according to which the bars 7a–7f have the form of a three-dimensional curve, being determined by the punching out of the curved slots 8a–8e, produces the result that, during the plugging process, each point of contact moves in each case along the corresponding bar 7a–7f as well as the corresponding contact surface of the contact body. Because of the curved layout of the bars 7a–7f and the slots 8a–8e respectively a kind of screw or winch effect is obtained, when the plugging process takes place, with the result that the segmented body 1a having the form of a sleeve can be introduced into the plug-in socket more easily. In this way, the points of contact of the bars 7a–7f can be prevented from always touching the same contact lines on the cooperating contact surface. Thus, the entire circumference of the cooperating contact surface is used, with the result that the surface abrasion, which causes the oxidation and the superheating of the contact, becomes minimal.

Similar to the embodiment according to FIG. 1, the edge strips 4,5 may again possess apertures 12 which extend in each case their outer edges either up to the curved section 6 of a bar 7a–7f or merely towards this section, but not entirely up to it (compare with the reference symbols 12a and 12b in FIG. 2). As far as the effects obtainable by means of these measures are concerned, what has been said above in the context of the embodiment according to FIG. 1 applies here too.

Figure 3:
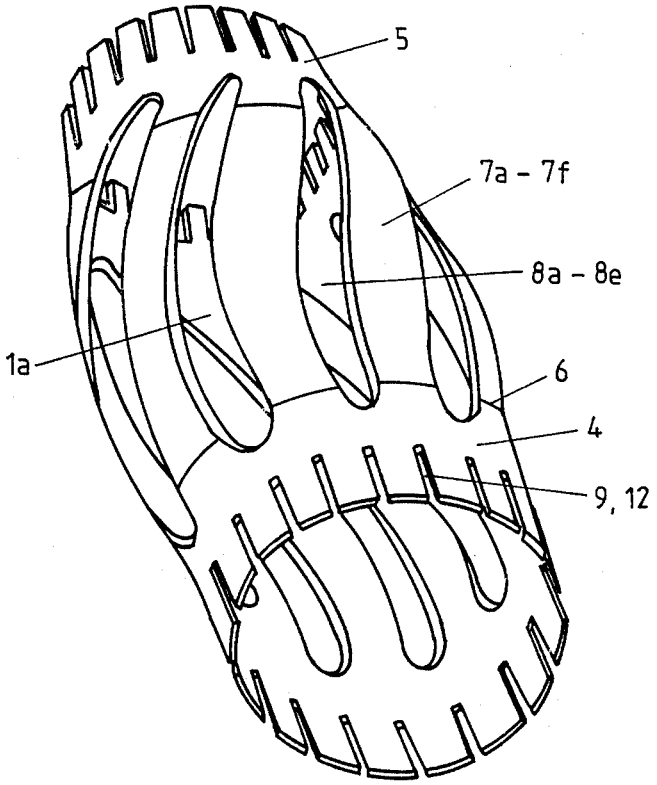
Figure 4:
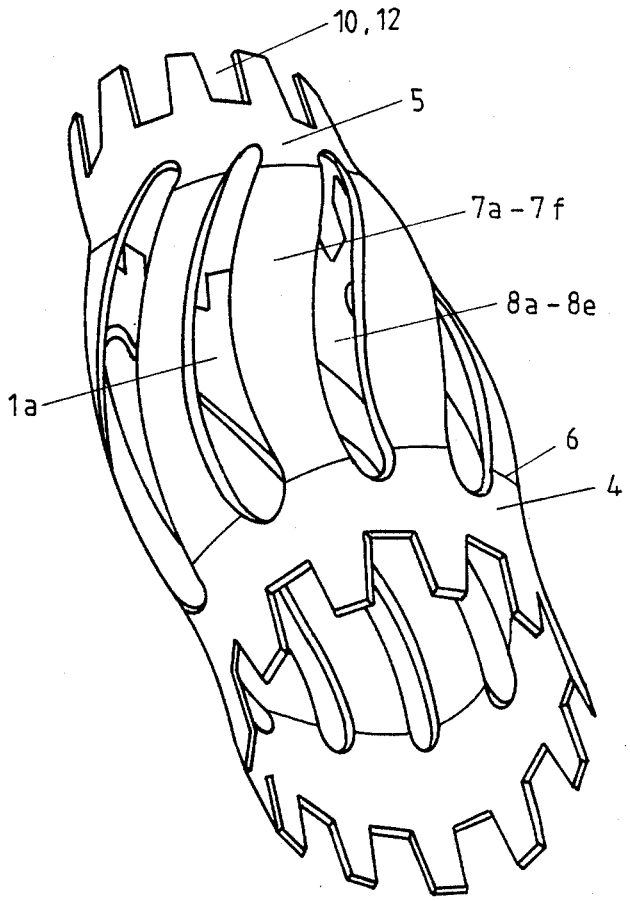

The segmented bodies depicted in FIG. 3 and 4 are similar to that according to FIG. 2. Their edge strips 4,5 show apertures 12 having the form of slots 9 (FIG. 3) and of a trapezoidal gear cutting (FIG. 4) respectively. Thereby, a plurality of additional points of contact are created in the area of the edge strips 4,5 leading to an improvement of the electrical contacts in this area. It is obvious that the apertures 12 may have other geometrical forms than those already mentioned.

Figure 5:
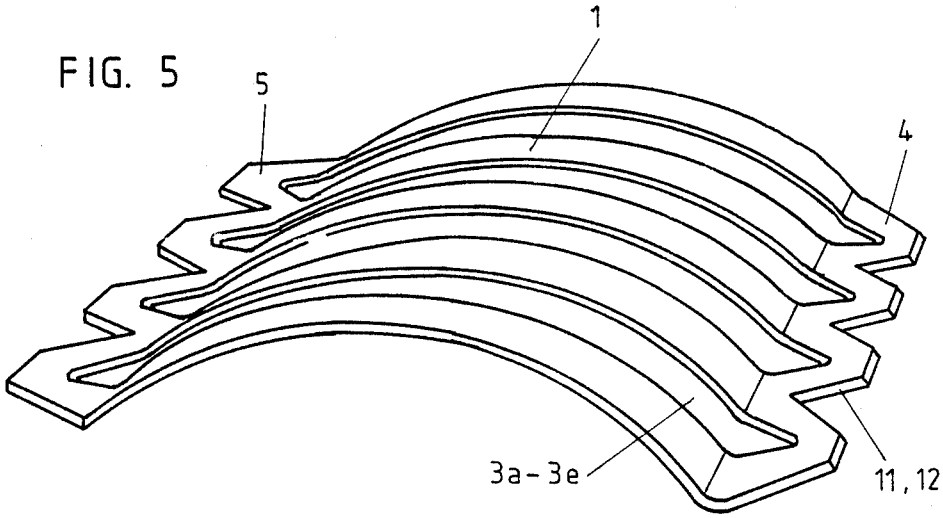

FIG. 5 shows a segmented body similar to that depicted in FIG. 1. Here, the edge strips 4,5 have apertures 12 with the form of a triangular gear cutting 11. The end portions of the slots 3a–3e are of triangular shape as well.

Figure 6:
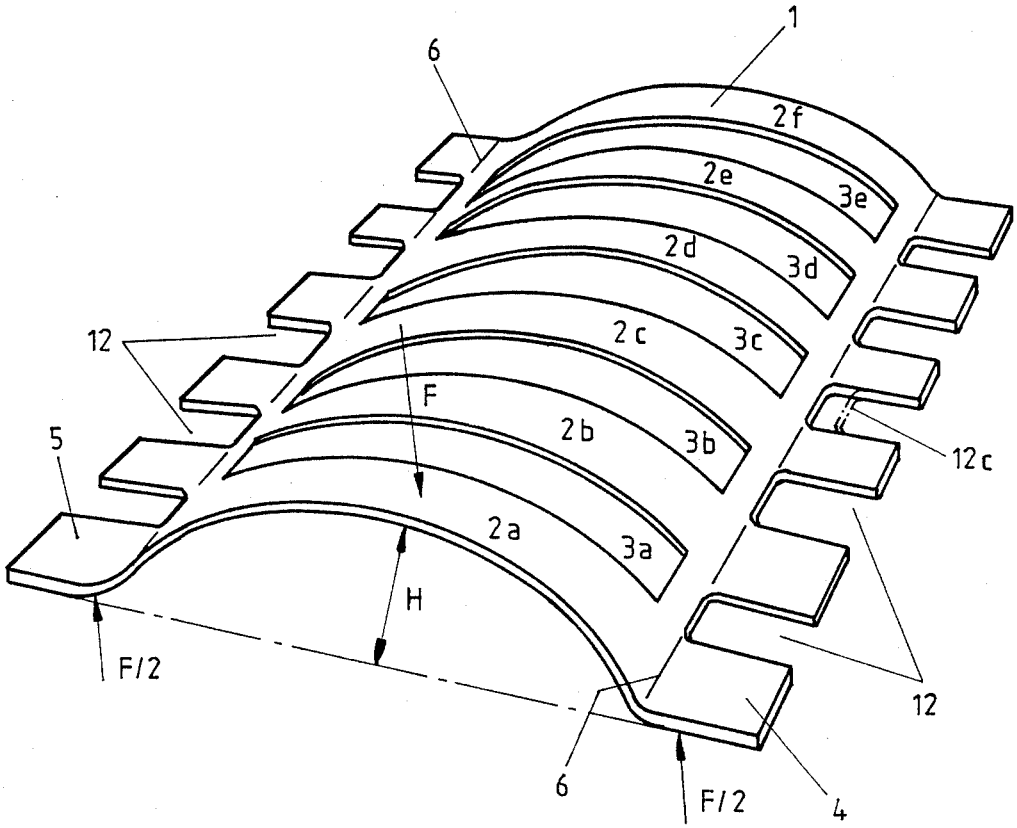

The segmented body shown in FIG. 6 has a great similarity to that depicted in FIG. 1. However, an essential difference exists in that in this embodiment the curved sections 6 are not to be found in the end areas of the bars 2a–2f (as in the embodiment according to FIG. 1), but form on the contrary a part of the edge strips 4,5. From this it follows that the slots 3a–3e do not extend up to these curved sections 6. In order to satisfy to the requirement of clearly defined points of contact it is therefore absolutely imperative to provide the edge strips 4,5 with apertures 12. These apertures 12 may be arranged in any possible way. Thus, they need not necessarily be in alignment with the slots 3a–3e (as depicted in FIG. 6). The apertures 12 extend from the outer edges of the edge strips 4,5 up to the curved section 6, but they may end before them as well (see reference symbol 12c in FIG. 6). On the basis of the above mentioned requirement, one has of course to make sure in the latter case that the points of contact lie within areas of the edge strips 4,5 comprising the apertures 12. Consequently, the points of contact ought to be situated in the vicinity of the outer edges of the edge strips 4,5 if the apertures 12 happen to be relatively short. This may be achieved through specific measures in the constructional design of the segmented bodies 1 and the contact bodies. Again, the apertures 12 may have any geometrical forms, in particular those depicted in FIGS. 3 to 5.

The segmented body 1 represented in FIG. 7 has a certain similarity to that depicted in FIG. 1. But unlike the segmented bodies described thus far, this one does not have a curved section 6. In view of the creation of clearly defined points of contact it is likewise indispensable under these circumstances that the edge strips 4,5 be provided with apertures 12. Once again, these apertures 12 may be rectangular or possess the form of a triangular or trapezoidal gear cutting or any other geometrical form. Moreover, their arrangement is optional in a sense that they need not necessarily be in alignment with the slots 3a–3e (as shown in FIG. 7). The edge strips 4,5 of the segmented body 1 according to FIG. 7 are approximately flat (compare with FIGS. 7 and 9). However, this is by no means compelling. Basically, the end areas of the bars 2a–2f and the edge strips 4,5 may have any form, especially the one depicted in FIG. 8, as long as (for the above-mentioned reasons) it is guaranteed that the points of contact lie within areas of the edge strips 4, 5 comprising the apertures 12 (see the cross-sections shown in FIG. 8 and 9 bearing the reference symbol B).

The embodiments according to FIGS. 6 and 7 are based on segmented bodies 1 similar to that depicted in FIG. 1. Even though they are not represented in the drawings, it is obvious that the present invention comprises also embodiments of this kind having sleeve-shaped segmented bodies 1a which are formed analogously to the ones contained in FIGS. 2 to 4. Thus, with respect to this, there exists no limitation.

What is claimed is:

1. Electric contact apparatus comprising at least one segmented body having a plurality of oblong contact bars, determined by and separated from each other by slots and being arranged side by side in at least one row, said contact bars in their central portion having a shape curved in a plane across the direction defined by said row and being linked together at each one of their ends through a linking strip extending over said row of contact bars, in which said contact bars in at least one of their end ranges adjacent one of said linking strips include a section having a shape curved in a sense opposite to said curved central portion thereof, said linking strip having apertures each extending from the outer edge of the linking strip transverse to the direction defined by said row into the end section of one of said contact bars so as to overlap in a direction transverse to said row with the slots determining said contact bar.

2. Electric contact apparatus according to claim 1 in which said apertures extend from said outer edge of the linking strip into said curved section of the contact bar.

3. Electric contact apparatus comprising at least one segmented body having a plurality of oblong contact bars, separated from each other by slots and being arranged side by side in at least one row, said contact bars in their central portion having a shape curved in a plane across the direction defined by said row and being linked together at each one of their ends through a linking strip extending straight over said row of contact bars and substantially parallel to the direction defined by said row, in which at least one of said linking strips includes a section extending along said linking strip and having a cross-sectional profile curved in a direction transverse to the direction defined by said row and in a sense opposite to said curved central portion of said contact bars, said linking strip having apertures each extending from the outer edge of the linking strip transverse to the direction defined by said row into the end section of one of said contact bars so as to overlap in a direction transverse to said row with the slots determining said contact bar.

4. Electric contact apparatus according to claim 3, in which said apertures extend from said outer edge of the linking strip into said curved section of the linking strip.

5. Electric contact apparatus according to one of claims 1, 2, 3, or 4, characterized in that, in a horizontal projection, the slots of the segmented body are straight and extend oblique-angled to the linking strip.

6. Electric contact apparatus according to one of claims 1, 2, 3, or 4, characterized in that the slots of the segmented body have the form of a three-dimensional curve.

7. Electric contact apparatus according to one of claims 1, 2, 3, or 4, characterized in that the apertures have the form of slots.

8. Electric contact apparatus according to one of claims 1, 2, 3, or 4, characterized in that the apertures have the form of a gear cutting.

9. Electric contact apparatus according to one of claims 1, 2, 3, or 4, characterized in that at least one of said linking strips includes an outer longitudinal edge comprising a row of successive projections and recesses having a substantially trapezodial contour.

10. Electric contact apparatus according to one of claims 1, 2, 3 or 4, characterized in that at least one of said linking strips includes an outer longitudinal edge comprising a row of successive projections and recesses having a substantially triangular contour.

* * * * *